United States Patent [19]

Abthoff et al.

[11] 4,125,997

[45] Nov. 21, 1978

[54] AIR DISTRIBUTION SYSTEM FOR REDUCTION CATALYST AND OXIDATION CATALYST

[75] Inventors: Jörg Abthoff, Plüderhausen; Hans-Dieter Schuster, Grossheppach; Reiner Kreeb, Stuttgart, all of Fed. Rep. of Germany

[73] Assignee: Daimler-Benz Aktiengesellschaft, Fed. Rep. of Germany

[21] Appl. No.: 490,106

[22] Filed: Jul. 19, 1974

[30] Foreign Application Priority Data

Jul. 21, 1973 [DE] Fed. Rep. of Germany ..... 2337228

[51] Int. Cl.[2] ..... F01N 3/15

[52] U.S. Cl. ..... 60/289; 60/301; 60/306

[58] Field of Search ..... 60/301, 289, 306

[56] References Cited

U.S. PATENT DOCUMENTS

| | | | |
|---|---|---|---|
| 3,733,829 | 5/1973 | Henault | 60/301 |
| 3,757,521 | 9/1972 | Tourtellotte | 60/301 |
| 3,809,743 | 5/1974 | Unland | 60/301 |
| 3,825,654 | 7/1974 | Kobylinski | 60/301 |
| 3,826,089 | 7/1974 | Nakajima | 60/301 |
| 3,872,213 | 8/1972 | Haseba | 60/301 |

*Primary Examiner*—Douglas Hart

*Attorney, Agent, or Firm*—Craig & Antonelli

[57] ABSTRACT

An internal combustion engine with an exhaust line in which are arranged a reduction catalyst and downstream thereof an oxidation catalyst, whereby during the starting phase of the internal combustion engine, additional air is supplied to the reduction catalyst, and in the operationally warmed-up condition of the internal combustion engine, additional air is supplied to the oxidation catalyst while at the same time a part of the additional air continues to be fed to the reduction catalyst.

13 Claims, 3 Drawing Figures

FIG. 1
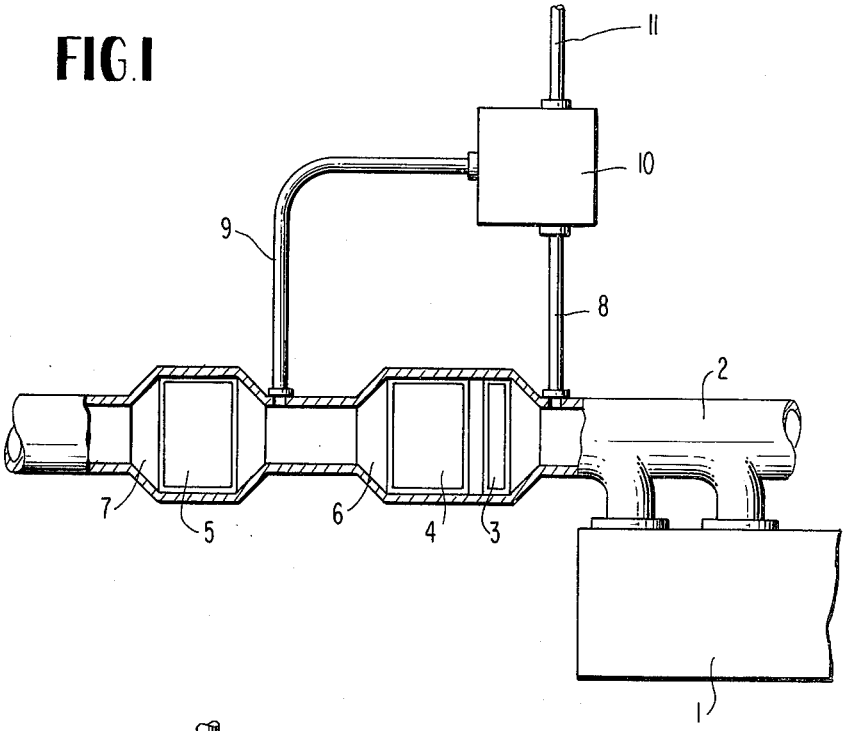
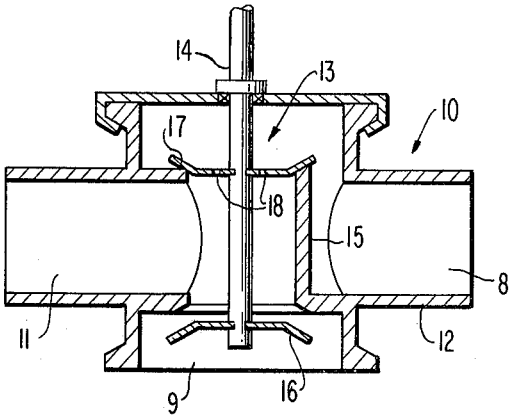
FIG. 2
FIG. 3
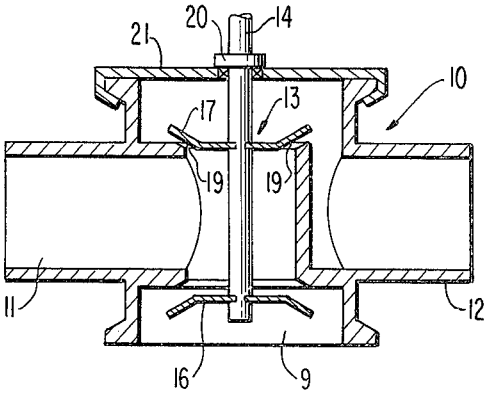

AIR DISTRIBUTION SYSTEM FOR REDUCTION CATALYST AND OXIDATION CATALYST

The present invention relates to an internal combustion engine with an exhaust line, in which are arranged a reduction catalyst and downstream thereof an oxidation catalyst, whereby auxiliary or additional air is fed to the reduction catalyst during the starting phase of the internal combustion engine and additional or auxiliary air is fed to the oxidation catalyst in the operational warmed-up condition of the internal combustion engine.

The two catalyst frequently do not reach the temperatures favorable for their operation even when the internal combustion engines are warmed-up to and are operating under normal operating conditions. This is in particular the case if a longer section of exhaust line is disposed upstream of the reduction catalyst or oxidation catalyst, in which the exhaust gases can cool off. The exhaust gases also cool off in that the reduction is an endothermic process.

The present invention is concerned with the task to keep the two catalyst at a high temperature favorable for their operation also under unfavorable circumstances and conditions.

The underlying problems are solved in accordance with the present invention in that a part of the additional or auxiliary air is fed to the reduction catalyst also in the operational warmed-up condition of the internal combustion engine.

The air supplied according to the present invention brings about that an exothermic oxidation is superimposed on the reduction within the reduction catalyst, and more particularly in a part thereof disposed upstream in the flow direction, which effects an increase of the temperature in the reduction catalyst and also in the oxidation catalyst so that these two catalyst exhibit a better operation and efficiency.

It is advantageous if the part of the auxiliary or additional air which is fed to the reduction catalyst, amounts to between about 3% and to about 20% of the entire additional or auxiliary air. The oxidation carried out with the aid of this air thereby effects a sufficient increase of the temperature without significantly disturbing the reduction in the reduction catalyst.

According to a further improvement of the present invention, an oxidation catalyst of relatively small volume, preferably of about 10% to about 20% of that of the reduction catalyst, is arranged in the exhaust line upstream of the reduction catalyst, through which flows the additional or auxiliary air fed to the reduction catalyst. The small oxidation catalyst which thus lies between the reduction catalyst and the discharge orifice of the additional or auxiliary air line in the exhaust line, takes over the first oxidation so that the reduction catalyst is not loaded thereby. The connection of a small oxidation catalyst ahead of the reduction catalyst is already disclosed in the German Offenlegungsschrift No. 2,222,467, however, according to this disclosure, only the remainder or residue in oxygen, which still remains in the exhaust gases, is to be eliminated in order to achieve subsequently a better reduction.

In an internal combustion engine with a line for the additional air which bifurcates into two lines, of which one line leads to the reduction catalyst and the other to the oxidation catalyst, with a three-way valve in the bifurcation, the valve in the first end position may open the line to the reduction catalyst and close the line to the oxidation catalyst as well as in the second end position may open the line to the oxidation catalyst and keep the line to the reduction catalyst open with an opening cross section which is small in relation to the opening cross section of the line to the oxidation catalyst. The condition of the additional air in the starting phase and in the operational warmed-up condition of the internal combustion engine, i.e., with an engine under hot-running conditions, is controlled with the two end positions of the valve. However, all transitional conditions between the two end positions of the valve are also possible.

A favorable division of the additional air with an operationally warmed-up internal combustion engine results, if in the second end position of the valve, the opening cross section of the line to the reduction catalyst amounts to about 10% of the opening cross section of the line to the oxidation catalyst.

This smaller opening cross section can be formed in that the closure body of the valve does not close completely in the second end position. Another possible embodiment consists in that in the second end position of the valve, the opening cross section which opens the line to the reduction catalyst is constructed as at least one bore in the valve housing or in the closure body.

Accordingly, it is an object of the present invention to provide an internal combustion engine with an exhaust line equipped with a reduction catalyst and an oxidation catalyst that avoids the aforementioned shortcomings and drawbacks encountered in the prior art.

Another object of the present invention resides in an internal combustion engine with an exhaust gas line system equipped with reduction and oxidation catalysts which assures that the catalysts reach the temperatures favorable for their operation under all operating circumstances.

A further object of the present invention resides in an exhaust gas system equipped with a reduction catalyst and an oxidation catalyst for internal combustion engines, in which the two catalysts are kept at sufficiently high temperatures, favorable for optimum operation, even under unfavorable operating conditions.

Still a further object of the present invention resides in an internal combustion engine equipped with an exhaust line system of the type described above in which the reduction and oxidation catalysts operate with improved efficiency.

Still another object of the present invention resides in an exhaust gas line system equipped with reduction and oxidation catalysts for internal combustion engines in which a favorable division of additional, auxiliary air is realized when the internal combustion engine is warmed-up to its normal operating temperature.

A further object of the present invention resides in an internal combustion engine with an exhaust line system of the type described above which is simple in construction, yet highly effective for its intended purposes.

These and other objects, features, and advantages of the present invention will become more apparent from the following description when taken in connection with the accompanying drawing which shows, for purposes of illustration only, two embodiments in accordance with the present invention, and wherein:

FIG. 1 is a somewhat schematic view, partly in cross section, of an exhaust line of an internal combustion engine with supply lines for the conduction of additional, auxiliary air in accordance with the present invention;

FIG. 2 is a cross-sectional view through a valve in accordance with the present invention interconnected in the lines for the additional, auxiliary air; and FIG. 3 is a cross-sectional view, similar to FIG. 2, through a modified embodiment of a valve in accordance with the present invention.

Referring now to the drawing wherein like reference numerals are used throughout the various views to designate like parts, and more particularly to FIG. 1, the exhaust gases which leave the internal combustion engine 1, flow through three series-arranged catalysts disposed in the exhaust line 2, and more particularly at first through an oxidation catalyst 3, then through a reduction catalyst 4 and finally again through an oxidation catalyst 5. The first oxidation catalyst 3 is considerably smaller than the reduction catalyst 4, their respective volumes are preferably in the range of ratios between about 1 to 10 and about 1 to 5. These two catalysts 3 and 4 are arranged closely one behind the other within a common catalyst bed 6 of any conventional construction whereas the second oxidation catalyst 5 is disposed in a separate catalyst bed 7.

One respective line 8 and 9 for the conduction of additional, auxiliary air into the exhaust line 2 terminates at the beginning of the two catalyst beds 6 and 7, as viewed in the flow direction. The lines 8 and 9 start from a three-way valve generally designated by reference numeral 10 which is connected by way of a further line 11 with an air feed device of any conventional type, such as a blower or compressor.

The three-way valve 10 illustrated in greater detail in FIGS. 2 and 3, essentially consists of a valve housing 12 and of a closure body generally designated by reference numeral 13 having an axially movable rod 14, at which are secured two closure plates 16 and 17. In the upper end position of the closure body 13, the closure plate 16 closes the line 9 so that the air flowing-in through the line 11 is fed through the line 8 to a point upstream of the oxidation catalyst 3 and the reduction catalyst 4.

In the lower end position of the closure body 13 (as shown in FIG. 2), the line 9 is opened so that the additional air is fed to the oxidation catalyst 5. However, a part of the additional air is continued to be conducted through the line 8 upstream of the oxidation catalyst 3 and the reduction catalyst 4 through apertures 18 provided in the upper closure plate 17. Such an opening or openings may also be provided in the wall 15 of the housing 12.

As shown in FIG. 3, it is also possible that the closure plate 17 does not completely close in the lower end position of the closure body 13 so that an opening cross section 19 remains preserved, through which additional air can flow into the line 8. For purposes of determining the lower end position of the closure body 13, an abutment or stop 20 is secured at the rod 14 which abuts at a sheet metal cover plate 21 of the three-way valve 10.

The valve 10 is actuated automatically in each case by conventional means as a function, for example, of engine temperature, exhaust gas temperature, etc. Since such means are known in the art and form no part of the present invention, a detailed description thereof is dispensed with herein.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What we claim is:

1. An exhaust gas line system for an internal combustion engine with an exhaust line means in which are arranged a reduction catalyst means and downstream thereof an oxidation catalyst means, with additional air being fed to the reduction catalyst means during the starting phase of the internal combustion engine and to the oxidation catalyst means during the hot running condition of the internal combustion engine, means for feeding a portion of the additional air fed to the reduction catalyst means also in the hot-running condition of the internal combustion engine in amounts between about 3 and about 20% of the entire additional air, and an oxidation catalyst means of relatively small volume being arranged in the exhaust line means upstream of the reduction catalyst means, the additional air fed to the reduction means also flowing through the oxidation catalyst means of small volume with a line for the additional air which bifurcates into two further lines, of which one leads to the reduction catalyst means and the other to the oxidation catalyst means, and which includes a three-way valve means in the bifurcation, characterized in that the valve means in a first end position opens the further line to the reduction catalyst means and closes the further line to the oxidation catalyst means and in the second end position opens the further line to the oxidation catalyst means and keeps the further line to the reduction catalyst means open with an opening cross section that is relatively small in relation to the opening cross section of the further line leading to the oxidation catalyst means.

2. An exhaust gas line system according to claim 1, characterized in that in the second end position, the opening cross section of the further line leading to the reduction catalyst means amounts to about 10% of the opening cross section of the further line leading to the oxidation catalyst means.

3. An internal combustion engine according to claim 2, characterized in that the valve means includes a closure member which does not close completely in the second end position.

4. An exhaust line system according to claim 2, characterized in that the opening cross section which opens the further line to the reduction catalyst means in the second end position is constructed as at least one bore.

5. An exhaust line system according to claim 4, characterized in that the bore is arranged in the valve housing.

6. An exhaust line system according to claim 4, characterized in that the bore is provided in a closure member.

7. An exhaust gas line system according to claim 2, characterized in that the further oxidation catalyst means has a volume of about 10 to about 20% of the volume of the reduction catalyst means.

8. An exhaust gas line system for an internal combustion engine with an exhaust line means in which are arranged a reduction catalyst means and downstream thereof an oxidation catalyst means, with additional air being fed to the reduction catalyst means during the starting phase of the internal combustion engine and to the oxidation catalyst means during the hot-running condition of the internal combustion engine, means for feeding a portion of the additional air to the reduction catalyst means also in the hot-running condition of the internal combustion engine, and an oxidation catalyst means of relatively small volume being arranged in the exhaust line means upstream of the reduction catalyst means, the additional air fed to the reduction catalyst means also flowing through the oxidation catalyst means of small volume, the further oxidation catalyst means has a volume of about 10 to about 20% of the volume of the reduction catalyst means with a line for the additional air which bifurcates into two further lines, of which one leads to the reduction catalyst means and the other of the oxidation catalyst means, which includes a three-way valve means in the bifurcation, characterized in that the valve means in a first end position opens the further line of the reduction catalyst means and closes the further line to the oxidation catalyst means and in the second end position opens the further line to the oxidation catalyst means and keeps the further line to the reduction catalyst means open with an opening cross section that is relatively small in relation to the opening cross section of the further line leading to the oxidation catalyst means.

9. An exhaust gas line system according to claim 8, characterized in that in the second end position, the opening cross section of the further line leading to the reduction catalyst means amounts to about 10% of the opening cross section of the further line leading to the oxidation catalyst means.

10. An internal combustion engine according to claim 8, characterized in that the valve means includes a closure member which does not close completely in the second end position.

11. An exhaust line system according to claim 8, characterized in that the opening cross section which opens the further line to the reduction catalyst means in the second end position is constructed as at least one bore.

12. An exhaust line system according to claim 11, characterized in that the bore is arranged in the valve housing.

13. An exhaust line system according to claim 11, characterized in that the bore is provided in a closure member.

* * * * *